United States Patent [19]

Bryer et al.

[11] 4,159,823

[45] Jul. 3, 1979

[54] MULTIPLE PRODUCT FOLDER

[75] Inventors: Jack Bryer, Paramus, N.J.; Dominick Padalino, Brooklyn, N.Y.; Burton C. Polglase, Plainfield, N.J.

[73] Assignee: Wood Industries, Inc., Middelsex, N.J.

[21] Appl. No.: 823,949

[22] Filed: Aug. 12, 1977

[51] Int. Cl.[2] ..... B41F 13/56

[52] U.S. Cl. ..... 270/21; 270/71

[58] Field of Search ..... 270/70–75, 270/6–9, 20, 47–51, 21

[56] References Cited

U.S. PATENT DOCUMENTS

| | | | |
|---|---|---|---|
| 1,624,985 | 4/1927 | Sheldon | 270/71 |
| 2,555,267 | 5/1951 | Crafts | 270/72 |
| 2,991,995 | 7/1961 | Zuckerman | 270/50 |

*Primary Examiner*—Robert E. Bagwill

*Assistant Examiner*—A. Heinz

*Attorney, Agent, or Firm*—David S. Woronoff

[57] ABSTRACT

A multiple product folder in a high speed rotary web printing machine for the production of signatures with various folds has a plurality of various operating cylinders, such as a pair of web cutting cylinders, a signature collecting cylinder, signature transfer and folding cylinders for one transversal and for a second parallel fold and signature delivering cylinders, wherein certain cylinders are driven by gear trains for accomplishing more than one slow-down speed, which gear trains have shiftable couplings for changing the speed of the transfer cylinders from a full speed to a slow-down speed according to the requirements of forwarding and delivering of certain signatures, whereas a shifting from a slow-down to a full speed can be performed for a certain folding action and the slow-down delivery yet can be maintained.

8 Claims, 8 Drawing Figures

W
21
P
22
23
20

30
33
32
31
11
10
40
A
41
42
53
50
51
56
76
70
B
77
75
71
52
C
95
70
77'
76'
75'
C'
72'
72
91
90
D
71'
95'
91'
D'
90'
94
100
94'
100'

MULTIPLE PRODUCT FOLDER

BACKGROUND OF THE INVENTION (1) Field of the Invention

The invention relates to folders in high-speed web-fed rotary printing machines in general and particularly to folders with folding cylinders for producing signatures with various kinds of folds in magazine printing machines and with shiftable gears for driving the transfer and delivery cylinders of such folders for varying the angular velocity of these cylinders.

(2) Description of the Prior Art

Known in the art are folders in magazine-type printing machines with cutting, collecting, folding and delivery cylinders for various kinds of folds, mostly having multiple sets of folding elements in the folding cylinders and having also folding cylinders for so-called double-parallel folds. Some of these folders are arranged for several separate deliveries and for one or two-slow down mechanisms in order to obtain properly laid signatures on the delivery conveyors in high-speed orienting machines. Typical prior art patents of this kind are U.S. pat. Nos. 2,991,995, 3,032,335 and 3,059,921. The U.S. Pat. No. 2,991,995 teaches a folding mechanism for printing machines in which the folding and tucking cylinder has a reduced diameter thereby achieving a "slow-down." U.S. Pat. No. 3,032,335 teaches distributing cylinders of reduced diameter to slow-down the delivery of signatures. The distributing cylinders receive only alternate folded signatures. U.S. Pat. No. 3,059,921 teaches a paper folding machine having variable size primary folding cylinders to achieve a speed match with the printing cylinder.

Several problems turned up with increased production speeds of the magazine presses. One of these problems is a disorderly transfer and delivery of folded signatures, which causes troubles on the conveyors to the bindery, for which a single or even a double slow-down is insufficient for certain products with one or more than one transversal fold. Another problem is the time consuming job to change the speed reducing slowdown mechanism from a greater slowdown to a full speed operation, when it is desired to use the high speed capacity of the printing machine for certain folded products which can be delivered without trouble at the higher speed. Some of the prior art does not have even the facilities for changing the slow-down speed at all.

These and other problems which arise from the use of the higher speeds of modern magazines production printing machines are solved by this invention.

SUMMARY

The invention consists in such novel features, construction arrangements, combinations of parts and improvements as may be shown and described in connection with the apparatus herein disclosed by way of example only and as illustrative of a preferred embodiment.

The folder of this invention comprises a number of operating cylinders. A set of cutting cylinders for cutting the signatures off the paper web (which had been printed in the rotary printing machine) have a knife cylinder and a cutting bar cylinder. The latter has inserts against which the cutting knives operate and has adjacent to these bars cam-operated paper pins for transporting the severed signatures. Adjacent to the cutting bar cylinder is a signature collecting cylinder which has cam-operated paper pin sets for accepting the severed signatures from the pins of the cutting bar cylinder and, as the case may be, for collecting successive signatures thereon. The signature collecting cylinder has also sets of folding blades which are adapted to cooperate with folding jaws of a first folding cylinder which is located in close relationship with the signature collecting cylinder. The signatures, which had been cut off the paper web, receive by these mechanisms a first transversal fold, which may be an "even" fold or may have one folded side slightly overfolded over the other side, becoming a so-called "economy fold."

The folded signatures are now transferred to a next following transfer cylinder carrying cam-operated grippers for taking the folded signatures out of the folding jaws of the preceding cylinder. The transfer cylinder is driven by a gear from the first folding cylinder in such manner that the peripheral speed of the transfer cylinder is slower than the peripheral speed of the folding cylinder. The transfer cylinder has further a set of folding blades for a second transversal folding operation of the signatures which folding blades cooperate with corresponding cam-operated jaws of the second folding cylinders also has. The second folding cylinders sets of cam-operated transfer grippers. The now twice folded signatures are transferred to the adjacent delivery cylinders which have corresponding sets of cam-operated grippers for taking the signatures out of the folding jaws or for the transfer from the sets of grippers of the second folding cylinders and for depositing the folded signatures on the belts of the delivery conveyors.

The transfer cylinder, the two folding jaw cylinders and the delivery cylinders have two gear trains each in which shiftable gear couplings are provided for engaging the one or the other gear train, as may be desired. The one gear train set is for a 1:1 transmission ratio, the other set is laid out for a speed reduction ration resulting in two successive angular slow-down motions of the folding jaw and the delivery cylinders.

Thus, two modes of operations are made possible: A high speed production of signatures with a single fold, called also a "tabloid," over a first peripheral slowdown, being delivered over a transfer with two successive further slowdown steps, and a production of signatures with a double-parallel fold including the same peripheral slowdown whereby the second fold is performed without a slowdown step and a second slowdown step is performed to the delivery cylinders.

The gist and the nature of the invention is the improvement of the signature folding devices by the combination of shiftable cylinder gear drives for attaining multiple speed reductions, i.e., slowdowns, for proper handling and delivering of various products. Objects and advantages of the invention will be set forth in part hereafter and in part will be obvious herefrom or may be learned by practicing the invention, the same being realized and attained by means of the instrumentalities and combinations pointed out in the appended claims.

It is an object of the invention to provide drive gear trains with various transmission ratios for folding and transfer cylinders in high-speed magazine folders, which can be shifted from one speed ratio to another.

A further object of the invention is to provide shiftable gear couplings in the drive gear trains of the various cylinders of a magazine-type folder for attaining more than one angular slowdown of the cylinders.

Furthermore it is an object of the invention to provide means in a magazine-type folder, which renders the operation thereof more adaptable to a more efficient production of various kinds of folded signatures.

Various further and more specific purposes, features and advantages will appear from the detailed description given below taken in connection with the accompanying drawing which forms part of the specification and illustrates merely by way of example an embodiment of the device of the invention.

BRIEF DESCRIPTION OF THE DRAWING

In the following description and in the claims, parts will be identified by specific names for convenience, but such names are intended to be as generic to their application to similar parts as the art will permit. Like references characters denote like parts in the several figures of the drawing, in which

DESCRIPTION OF THE PREFERRED EMBODIMENT

Figure 1:
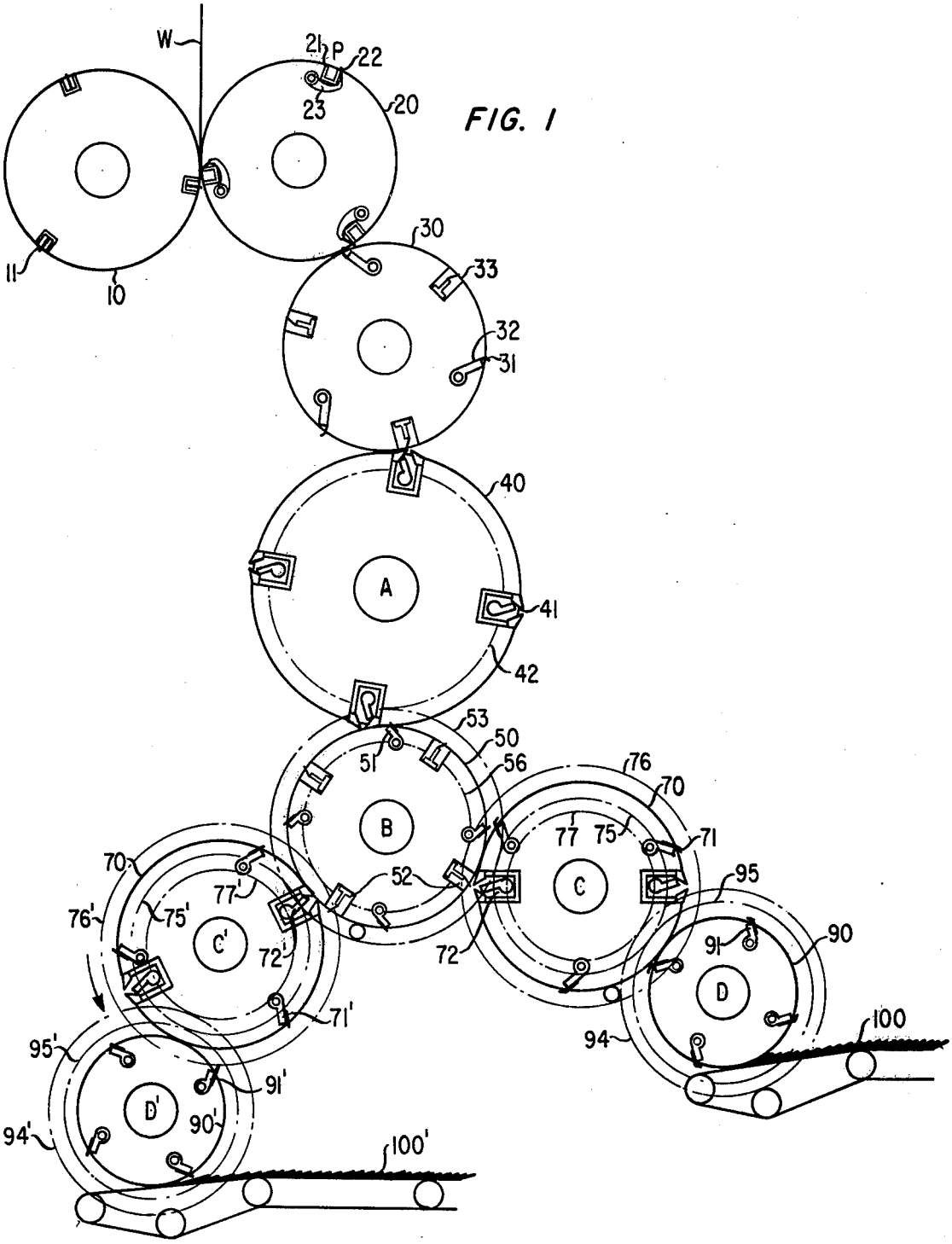
FIG. 1 shows diagrammatically the cylinder arrangement of a multi-cylinder magazine-type folder.

Referring now in more detail to the drawing illustrating a preferred embodiment by which the invention may be realized, there is in FIG. 1 a magazine-type folder comprising a cutting knife cylinder 10, a cutting bar cylinder 20, a collecting and first folding cylinder 30, a first folding jaw cylinder 40, a second folding blade and transfer gripper cylinder 50, the second folding jaw and transfer gripper cylinders 70 and 70' and the delivery cylinders 90, 90'. Cutting knife cylinder 10 has three sets of web cutting knives 11 which cooperate with the three cutting bars 21 of cutting bar cylinder 20. Cutting bar cylinder 20 has also three sets of cam-operated paper transporting pins 22 mounted on movable pin levers 23 (cam not shown in the drawing). The signatures which have been cut off the paper web W, are carried forward by paper transporting pins 22 and are transferred to and picked up by the corresponding paper transporting pins 31 of collecting and first folding blade cylinder 30. Pins 31 are mounted on movable pin levers 32 which are cam-operated (cam not shown in the drawing). Signatures can be collected on pins 31 depending on the cam operation, if so desired. A first set of signature folding blades 33 is also mounted on cylinder 30. A set of cam-operated first folding jaws 41 is arranged on folding jaw cylinder 40 for cooperative action with folding blades 33 (cam not shown in the drawing). Cylinders 10, 20, 30 and 40 are driven by a gear train for running at the same peripheral speed.

Figure 7:
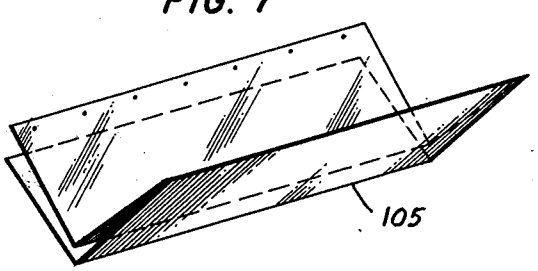
FIG. 7 shows a double-parallel folded signature with an economy fold.
Figure 5:
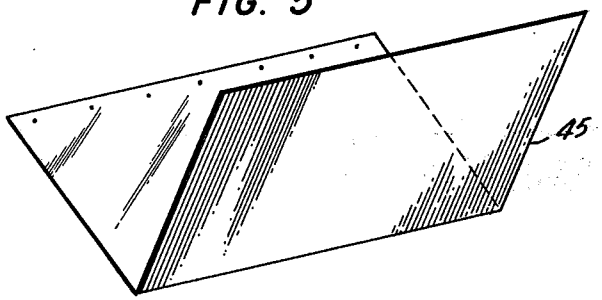
FIG. 5 shows a folded signature with a single fold.
Figure 6:
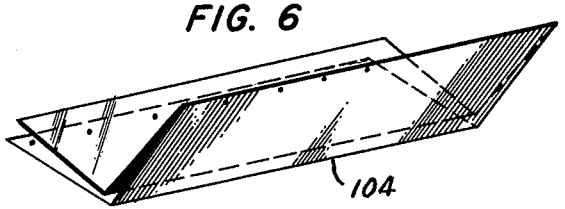
FIG. 6 shows a folded signature with a double-parallel fold, even edge folded.

The folded signatures 45 (FIG. 5) which had been folded by the operation of folding jaws 41 and folding blades 33 are taken out of jaws 41 by the cam-operated transfer grippers 51 of second folding blade and transfer gripper cylinder 50 which also carries a set of second folding blades 52. A gear 53 having a larger diameter than cylinder 50 is mounted on the shaft 55 of cylinder 50 for being driven by the gear 42 which is mounted on the same gear hub 43 on the shaft 46 of cylinder 40 together with the drive gear 44 thereof. Since gear 42 has a smaller diameter than cylinder 40, a peripheral slowdown at the transfer point from jaws 41 to grippers 51 is achieved. Second folding blades 52 which are arranged on cylinder 50 at the proper distance from grippers 51 for a second parallel folding action of the signatures, are disposed to cooperate with the cam-operated second folding jaws 72, 72' of second folding jaw and transfer cylinders 70, 70'. Double-parallel folded signatures 104, 105 thus obtained are shown in FIGS. 6 and 7 respectively. The grippers 91, 91' of delivery cylinders 90, 90' are set to take the folded signatures out of jaws 72, 72' and lay them down on the conveyor belts 100, 100'.

Cylinders 70, 70' have on their shafts 73, 73' gears 74, 74', which are driven by the gear 54 of cylinder 50. Since gears 74, 74' have the same diameter as gear 54, cylinders 50 and 70, 70' rotate at the same angular speed.

A similar drive arrangement is provided on cylinders 70, 70' for driving delivery cylinders 90, 90'. To this extent gears 75, 75' are disposed on shafts 73, 73' to engage gears 95, 95' on hubs 92, 92' on cylinder 90, 90'. So that cylinders 90, 90' rotate at the same angular velocity as cylinders 70, 70'. Since cylinders 90, 90' have smaller diameters than cylinders 70, 70', the peripheral speed of the former is thereby slowed-down.

Cylinders 70, 70' have further mounted thereon the sets of transfer grippers 71, 71' for transferring signatures having only a single transversal fold (45 in FIG. 5) to delivery cylinders 90, 90' by cooperating with grippers 91, 91' thereof. It is, however necessary to slow down the delivery of single folded signatures much more than by the first peripheral slowdown from cylinder 40 to cylinder 50 and by the peripheral slowdowns of cylinders 90, 90', as described above. To this extent a further gear train from cylinder 50 to cylinders 70, 70' consisting of gear 56 on cylinder 50 and gears 76, 76' on cylinders 70, 70' are provided. Both gears 54 and 56 are freely rotatable mounted on antifriction bearings 57, 58, respectively, on shaft 55 of cylinder 50. In order to provide a third and final slowdown of the delivery cylinders, gears 77, 77' are provided on shafts 73, 73', which gears engage gears 94, 94' mounted on hubs 93, 93' of cylinders 90, 90'. Since gears 94, 94' have a larger diameter than gears 77, 77', the velocity of delivery cylinders 90, 90' is substantially less than the velocity of cylinders 70, 70', resulting in an improved delivery of the folded signatures on conveyor belts 100, 100'. Gears 75, 75' and 77, 77' are freely rotatably mounted on antifriction bearings 78, 78' and 79, 79'.

In order to facilitate the slowing down of the angular velocity of cylinders 70, 70' and 90, 90' the following gear shaft means are provided.

Figure 3:
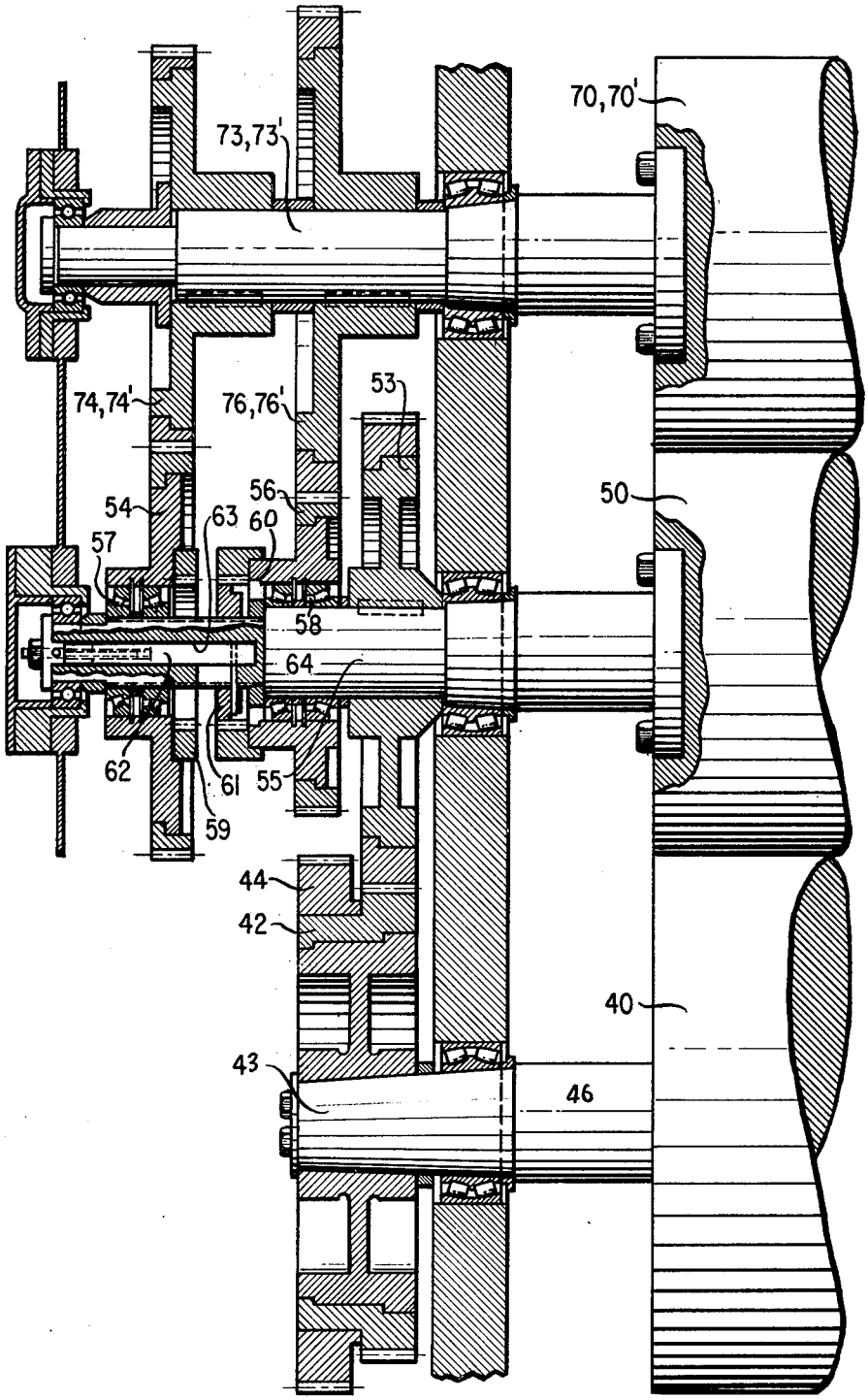
FIG. 3 shows the drive gear train with the gear shift device of the folding and transfer cylinders on one side of the folder shown in FIG. 1.
Figure 4:
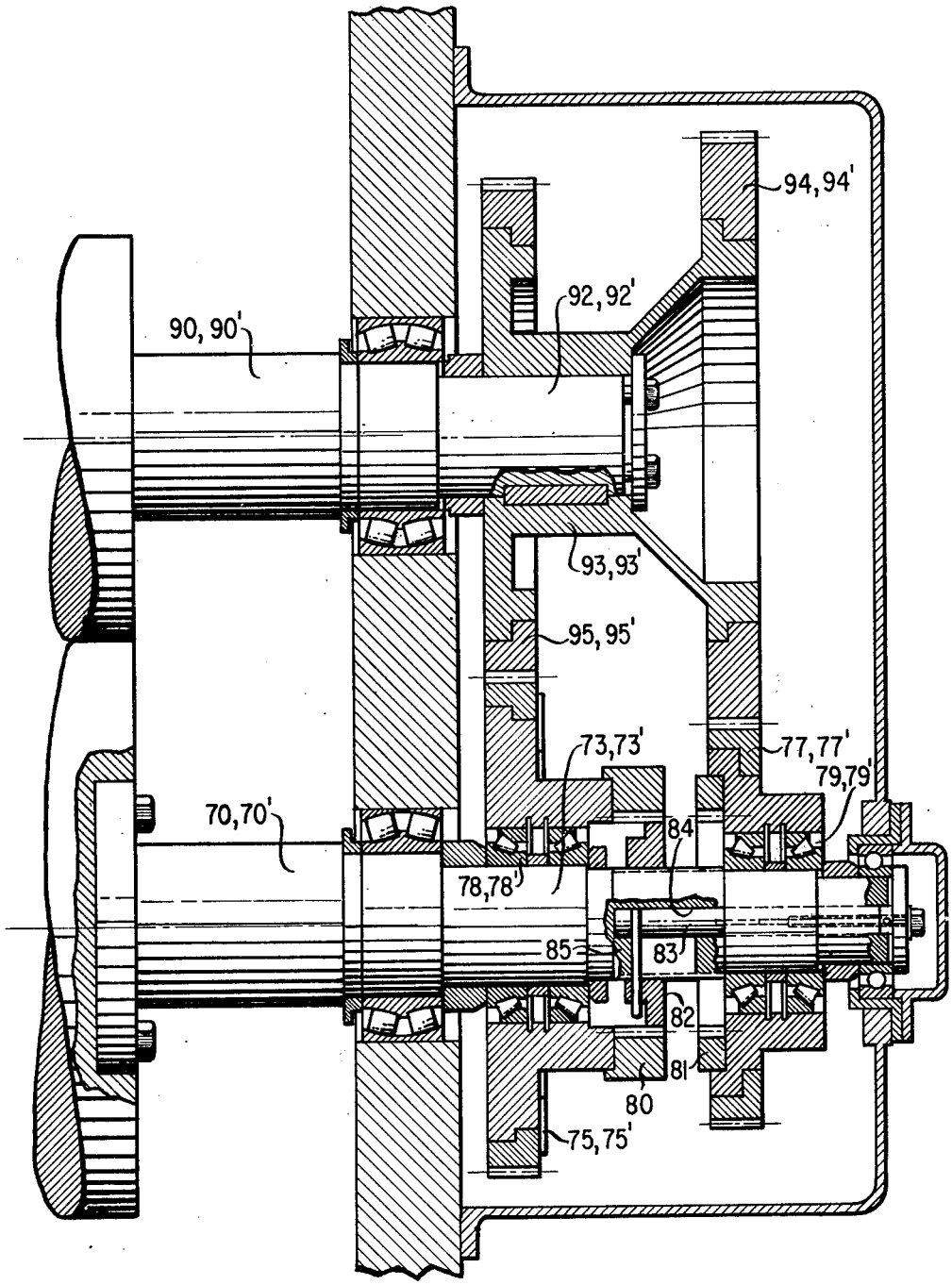
FIG. 4 shows the gear train with the gear shift device of the transfer and delivery cylinders on the other side of the folder shown in FIG. 1.

Gear 54 of cylinder 50 (FIG. 3) has on one side thereof an internal gear ring 59 and gear 56 has on the side facing gear 54 an internal gear ring 60 having the same diameter and number of teeth as gear ring 59. A coupling gear 61 having the same mating diameter and number of teeth as gears 59 and 60 is slidably mounted on shaft 55 where it is also secured by slide keys or splines in rotating engagement with shaft 55. A pin 62 is slidably arranged in a central bore 63 of shaft 55 having a pin 64 engaging gear 61. By sliding pin 62 axially in bore 63, gear 61 can be coupled with either ring gear 59 of gear 54 or with ring gear 60 of gear 56 for slowing down the angular velocity of cylinder 70, 70'. The gear shift means of cylinders 70, 70' for slowing down the angular velocity of cylinders 90, 90' are basically the same as those of cylinder 50. Gears 75, 75' of cylinders 70, 70' (FIG. 4) have on one side thereof an internal gear ring 80 and gears 77, 77' have on the side facing gears 75, 75' an internal gear ring 81 having the same diameter and number of teeth as gear ring 80. A coupling gear 82 having the same mating diameter and number of teeth as gears 80 and 81 is slidably mounted on shafts 73, 73' where it is secured by slide keys or splines in rotating engagement with shafts 73, 73''. A pin 83 is slidably arranged in a central bore 84 of shafts 73, 73' having a pin 85 engaging gear 82. By sliding pin 83 axially in bore 84, gear 82 can be coupled with either ring gear 80 of gears 75, 75' or with ring gear 81 of gears 77, 77' for slowing down the angular velocity of delivery cylinders 90, 90'.

The modes of operation may be described in connection with the diagram shown in FIG. 1. Signatures are printed on paper web W in the high speed printing machine and are cut off by cutting cylinders 10 and 20 and are transferred by the interaction of the paper pins from cylinder 20 to collecting cylinder 30. Two consecutive signatures may be collected thereon on the paper pins, and the collected signatures are folded to page size (also called "Tabloid") by the interaction of the folding blades on cylinder 30 with the folding jaws 41 on cylinder 40. The folded signatures, which were traveling up to this point at full speed, are taken out of folding jaws 41 by grippers 51 of cylinder 50 which has a slow-down peripheral speed slower than that of cylinder 40. The signatures are transferred by grippers 51 of cylinder to the grippers 71 of the next cylinder 70, 70'. By shifting coupling gear 61 on shaft 55 of cylinder 50 into engagement with gear 56, which meshes with gears 76, 76' of cylinders 70, 70', the angular velocity of the latter is slowed down. The flow of the signatures, which has been slowed down from cylinder 40 to cylinder 50 may or may not be divided at this point into two paths, each one of which is leading to signature deliveries on belt conveyors 100, 100'. Delivery cylinders 90, 90' have grippers 91, 91' to take the signatures out from grippers 71, 71' of cylinders 70, 70'. In order to ensure a good, orderly deposition of the folded signatures on the conveyor belts, the angular velocity of cylinders 90, 90' is further slowed down by engaging drive gears 77, 77' by shifting coupling gear 82 into gear ring 81, thus coupling gears 77, 77' with cylinder shafts 73, 73'. The final result can be a triple slowdown for this kind of product.

Obviously the further slowdown of cylinders 90, 90' may not be needed. To this extent coupling gear 82 on shafts 73, 73' of cylinders 70, 70' can be shifted into engagement with gears 75, 75' meshing with gears 95, 95' having the same size of the former, thus having cylinders 90, 90' rotating with a smaller peripheral velocity as cylinders 70, 70'.

Other signatures may be produced, which have pages of half the size of the former ones, by folding them twice in a parallel manner. The printed signatures are cut off the paper web and are transferred to the collecting cylinder where they may or may not be collected and where they receive the first transversal fold by the interaction of the folding blades of the collecting cylinder with the folding jaws of the folding jaw cylinder 40. Grippers 51 of the second folding transfer and folding blade cylinder 50 take the first folded signatures out of jaws 41 whereby the peripheral speed of transfer and folding blade cylinder 50 is slowed down. In this reduced speed the signatures are getting the second, so-called double-parallel fold, by the interaction of folding blades 52 with folding jaws 72 of the following jaw and transfer cylinder 70, 70'. The folding action cannot be performed at a slowdown point, therefor the coupling gear 61 on the shaft 55 of cylinder 50 must now be engaged with gear 54 meshing with gears 74, 74' having the same size as the former ones. Thus cylinder 50 and cylinders 70, 70' have the same angular velocity. For a good delivery of the folded signatures on the conveyors 100, 100' it is desirable to slow down the delivery cylinders 90, 90' in the same manner, as outlined above, thus resulting eventually in a double slow down of the double folded signatures.

Figure 2:
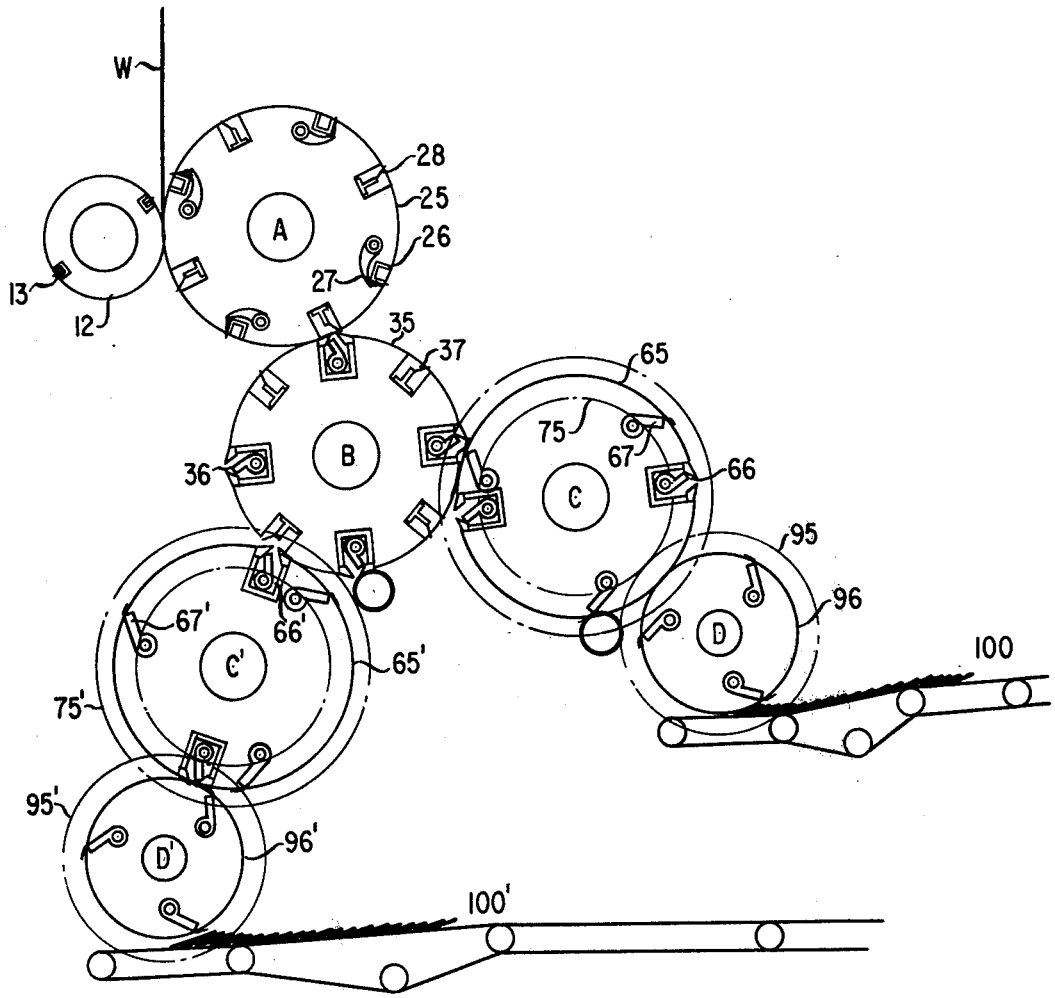
FIG. 2 shows diagrammatically the cylinder arrangement of another version of a magazine-type folder.
Figure 8:
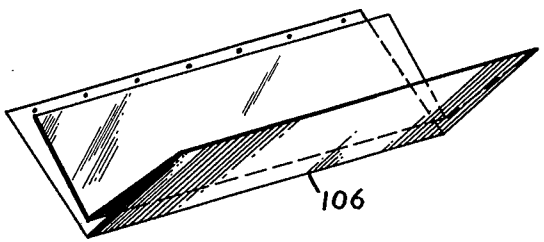
FIG. 8 shows a signature with another double-parallel fold.

Another embodiment of the invention is shown in FIG. 2, wherein the cylinder combination and arrangement permits also the production of single folded or double-parallel folded signatures with gearing arrangements on folding and transfer cylinders with couplings for full speed or angular slowdown velocities. However, only double-parallel folded signatures 104, 106 as shown in FIGS. 6 and 8 respectively may be obtained, not the so-called "economy" fold shown in FIG. 7.

There is in this embodiment a cutting knife cylinder 12 having two sets of cutting knives 13, a cutting bar and first folding blade cylinder 25 having multiple sets of cutting bars 26, cam-operated paper transporting pins 27 and folding blades 28. The next-following folding jaw cylinder 35 has folding jaws 36 cooperating with folding blades 28 and has also folding blades 37 for the double-parallel fold. Cylinder 35 has also the double gear train arrangement with the shiftable coupling means as shown and described in FIG. 3 with the first embodiment for cylinder 150 for a first angular slowdown of the second folding jaw and gripper transfer cylinders 165, 165', which has two sets of folding jaws 166, 166' and three sets of transfer grippers 167, 167'. Cylinders 165, 165' have further the double gear train arrangement with the shiftable coupling means as shown and described in FIG. 4 with the first embodiment for the second angular slow down velocity of the cylinders 190, 190', for the second angular slowdown velocity of the delivery cylinders 196, 196' which have in this case three sets of grippers 197, 197'. The modes of operation in this second smaller embodiment of the invention shown in FIG. 2 is basically the same as in the embodiment shown in FIG. 1 with the exception of the peripheral speed slowdown and thus not achieving a possible maximum triple slowdown for certain signatures having a single fold (tabloids). It is feasible to set the folders, so that, when running a straight product, for a divided flow of products as it has been described above, one delivery may deliver products with a tabloid fold, and the second delivery will deliver products with a double-parallel fold. This may not be a general requirement but could satisfy a unique condition.

While the invention has been described and illustrated with respect to a certain preferred example which gives satisfactory results, it will be understood by these skilled in the art after understanding the principle of the invention, that various other changes and modifications may be made without departing from the spirit and scope of the invention as expressed in the appended claims.

We claim:

1. In a high speed web fed printing press comprising a web feeding and cutting means and having at least two sets of folding and transfer means for folding and transferring sheets cut from the web; a gear transmission means for driving said folding and transfer means at different speeds and having a plurality of gear members in which at least two of said gear members have different diameters and numbers of teeth; said gear transmission means having a movable coupling means carrying said at least two gear members and mounted for alternatively engaging one of said gear members to selectively change the relative speed of at least one of said sets of folding and transfer means.

2. The device claimed in claim 1 wherein said two gear members of different diameters and numbers of teeth each have internal ring gear portions and said movable coupling means comprises a gear member slidably mounted on a shaft member.

3. The device claimed in claim 1 including further at least one delivery means interconnected to one of said folding and transmission means by a second transmission means wherein said second transmission means includes at least two gear members of different diameters and numbers of gear teeth and a movable coupling means for alternatively engaging one of said gear members with said transmission means.

4. The device claimed in claim 3 wherein said second transmission gear members each have internal ring gear portions and said movable coupling means comprises a gear member slidably mounted on a shaft member for selectively engaging one of said internal ring gear portions.

5. The device claimed in claim 1 wherein said folding and transfer means include:

first folding blade cylinder means,
first folding jaw cylinder means,
second folding blade cylinder means,
second folding jaw cylinder means;

delivery cylinder means such that products from said web cutting means are folded at least once by said folding blade and folding jaw cylinder means;

said first folding cylinder means has a first gear member and a cylinder member in a generally cylindrical shape wherein said first gear member has a smaller diameter than said cylinder member;

said second folding blade cylinder means has a cylinder member and first, second and third gear members each having a diameter wherein said first gear member has a larger diameter than said cylinder and which is adapted for mating with said first folding cylinder means first gear member so that, said second folding blade cylinder rotates more slowly than said first folding jaw cylinder means;

said second folding jaw cylinder means has a first and second gear member and a cylinder member each having a diameter;

said delivery cylinder means has a first gear member and a cylinder member each having a diameter; wherein said delivery cylinder first gear member is adapted for mating with said second folding cylinder means such that second delivery cylinder means and said second folding cylinder means rotates at the same angular velocity;

said second folding jaw cylinder means second gear member is adapted for mating with said second folding blade cylinder means second gear member wherein each of said second gear members rotate at the same angular velocity;

said second and third gear members of said second folding blade cylinder means each have an internal ring gear member formed thereon; and a coupling gear member is adapted for relative movement between said internal ring gear members and for mutual engagement therewith, such that the velocity of said second folding jaw cylinder member will be altered by the coupling of said internal ring gear members to said coupling gear member;

6. The device claimed in claim 1 wherein said first and second folding and transfer means comprises a plurality of rotating cylinder members having different peripheral velocities such that said second folding and transfer means peripheral velocity is less than that of said first folding and transfer means and said movable coupling means has first and second engaged positions with said gear transmission means such that said second position yields a further reduction in peripheral velocity of said second folding and transfer means relative to said first folding and transfer means.

7. The device claimed in claim 1 wherein at least one delivery means receives the products of said second folding and transfer means; said second folding and transfer means having at least one rotating cylinder means having a peripheral velocity; said delivery means comprises at least one rotatable cylinder member having a peripheral velocity less than that of said second folding and transfer means rotatable cylinder means; second gear transmission means interconnects said second folding and transfer means and said delivery means; said second gear transmission means has at least two gear members having different diameters and numbers of teeth and a movable coupling member mounted for being operatively connected to one of said transmission means gear members such that connection to one of said gear members will result in a further reduction of peripheral speed of said delivery means while connection to the other of said transmission means gear members will not change the peripheral speed of said delivery means.

8. The device according to claim 1 wherein said movable coupling means comprises a coupling gear member and a slidable pin member; said folding and transfer means has a shaft member for supporting said coupling gear member; said shaft member has a base formed therein for receiving said slidable pin member; said slidable pin member is fixed to said coupling gear member for causing its axial motion on said shaft member.

* * * * *